United States Patent [19]

Miller

[11] 3,976,119

[45] Aug. 24, 1976

[54] APPARAUS FOR APPLYING A FLUID COATING TO A MOVABLE ENDLESS CASTING SURFACE

[75] Inventor: Vernon J. Miller, Carrollton, Ga.

[73] Assignee: Southwire Company, Carrollton, Ga.

[22] Filed: Nov. 19, 1974

[21] Appl. No.: 525,137

[52] U.S. Cl. ..... 164/268; 118/70; 118/266; 164/73; 184/15 B

[51] Int. Cl.[2] ..... B22D 11/06; B05C 9/08; F16N 7/14

[58] Field of Search ..... 164/73, 74, 77, 87, 164/270, 72, 278, 268; 184/15 A, 100, 15 R, 19, 22, 25, 102, 7 D, 7 E, 10, 11 D, 61, 64, 102, 15 R, 15 B; 222/485; 118/70, 266, 267

[56] References Cited

UNITED STATES PATENTS

| | | | |
|---|---|---|---|
| 1,092,337 | 4/1914 | Catterall | 184/102 |
| 1,614,844 | 1/1927 | Misner | 184/22 |
| 1,949,612 | 3/1934 | Mattair | 184/19 X |
| 2,206,930 | 7/1940 | Webster | 164/278 X |
| 2,339,891 | 1/1944 | Tarnuzzer | 118/70 |
| 2,700,432 | 1/1955 | Hieger | 184/102 |
| 2,741,275 | 4/1956 | Johnsen | 184/15 R |
| 3,279,000 | 10/1966 | Cofer et al. | 164/73 X |
| 3,322,184 | 5/1967 | Cofer et al. | 164/278 X |
| 3,695,342 | 10/1972 | Petit | 164/278 X |
| 3,843,762 | 10/1974 | Sleigh | 164/87 X |

*Primary Examiner*—Robert D. Baldwin
*Assistant Examiner*—John S. Brown
*Attorney, Agent, or Firm*—Van C. Wilks; Herbert M. Hanegan; Stanley L. Tate

[57] ABSTRACT

A method of and apparatus for the continuous application of a fluid coating to a moveable endless casting surface to provide thermal protection for the casting surface and to facilitate the extraction of the cast bar from the casting mold and to prevent contamination of the casting machine coolant supply with the fluid coating, comprising a housing sealingly engaging a portion of the casting surface and means within the housing for directing jets of a fluid coating onto the engaged portion of the surface along paths substantially perpendicular to the direction of movement of the surface and wiping means positioned within the housing and in contact with the surface to remove and trap excess fluid coating.

7 Claims, 5 Drawing Figures

APPARAUS FOR APPLYING A FLUID COATING TO A MOVABLE ENDLESS CASTING SURFACE

BACKGROUND OF THE INVENTION

This invention relates generally to the continuous casting of metals on or between moveable endless casting surfaces, and more particularly to a method and apparatus for applying a fluid coating between cast metal and moveable endless casting surfaces.

Various metal casting operations involve the depositing of molten metal to be cast between moveable endless casting surfaces such as belts and wheels, the metal being solidified as it is transported between the moving surfaces and the casting being separated from the moving casting surfaces at a point spaced from the locality of molten metal delivery to the surfaces. In particular, continuous casting processes are known wherein the molten metal to be cast is fed continuously between a rotating water cooled casting wheel and a synchronously driven metal band which engages the circumference of the rotating casting wheel. As the cast metal travels between the rotating casting wheel and the circumferential band, it solidifies and emerges from between the two surfaces as a continuous bar, ready to be rolled or otherwise worked. For purposes of illustration, the present invention will be described with specific reference to its use in a continuous copper bar casting operation such as just mentioned, but it is to be understood that the invention in its broader aspects may be utilized with other metals and in other continuous casting processes that employ moveable endless casting surfaces.

The production of a bar of acceptable quality in a moveable endless surface casting apparatus requires uniform heat extraction from the metal traveling between the casting surfaces. For achievement of this condition, the casting surfaces must be maintained in a substantially flat condition and must not become thermally distorted or warped as a result of contact with the molten metal. In addition, the solidifying metal must not adhere to the casting surfaces.

For these reasons, protection of the casting surfaces against excessive temperatures that might cause thermal distortion of their shape and to facilitate the separation of the cast bar from the casting surfaces in an apparatus of the aforementioned type must be coated with a suitable thermal barrier having heat insulating and other properties, the general concept of which is disclosed in U.S. Pat. No. 3,322,184.

Prior art attempts to solve these problems have not been totally satisfactory. The principal deficiency in the prior art methods has been the failure to uniformly apply thermal barrier to the casting surfaces, thus resulting in undesirable distortion and deterioration of the casting surfaces. Consequently, it has been customary to tolerate distortion and deterioration of the casting surfaces and in some instances, the undesirable segregation of alloying constituents in the cast metal to achieve easy extraction of the cast bar from the casting surfaces. Further, prior art techniques have been unsatisfactory because none have even addressed the problems of coolant contamination and fire hazards which constantly attend the application of coatings to the moving casting surface by present methods.

A variety of devices for applying thermal barriers to casting surfaces have been used in the prior art. These prior art devices have characteristically used various combinations and arrangements of sprays and internally flooded rollers and more recently prior art methods have included the manual application of a thermal barrier paint to the casting surfaces prior to casting and the continuous application of a powder release agent to the casting surfaces during casting. Such methods are cumbersome and require periodic intervals in which the casting machine is inoperative while the thermal barrier is being reapplied to the surfaces.

SUMMARY OF THE INVENTION

In view of the foregoing, it should be apparent that there is still a need in the continuous metal casting art for an effective and safe system for uniformly applying a thermal barrier to the casting surfaces of a continuous casting machine without contaminating the coolant supply of the machine.

It is therefore a primary object of this invention to provide a method of and apparatus for the continuous application of a fluid coating to a moveable, endless casting surface which will prevent the contamination of the casting machine coolant supply with the fluid coating.

Another object of the present invention is to provide a method for casting metals on or between moveable endless casting surfaces wherein the desired uniformity of heat transfer from the metal being cast through the casting surfaces and ease of separation of the cast bar from the casting surfaces are achieved with minimization or substantial elemination of the necessity for interrupting the casting operation to replace the coating on the casting surfaces.

Another object of the present invention is to provide a new and improved apparatus for the application of a thermal barrier to a moveable endless casting surface in a continuous casting machine.

Still another object of the present invention is to provide an apparatus for casting metals on or between endless moveable surfaces wherein a thermal barrier, which comprises a fluid coating, provides the desired uniformity of heat extraction from the solidifying metal.

Yet another object of the present invention is to provide an apparatus for casting metals on or between endless moveable surfaces wherein a thermal barrier which comprises a fluid coating provides for easy separation of cast metal from moveable endless casting surfaces with little or no interruption of continuous casting.

To accomplish these and other objects, the present invention broadly contemplates a fluid coating application device which comprises, a housing sealingly engaging a portion of a casting surface, means within the housing for directing jets of fluid coating onto the engaged portion of the casting surface, wiping means within the housing and in contact with the casting surface and means for mounting the housing upon a continuous casting machine.

The principal advantage of the present invention over prior art techniques is the cost savings which accrue from the use of the techniques disclosed herein. These cost savings are primarily derived from: decreased consumption of thermal barrier fluid during the coating operation, decreased machine down time and improved product quality.

A further advantage of the present invention is the operational safety of a continuous casting machine incorporating the present invention. The operational safety of a casting machine incorporating the present invention is improved because the controlled application of thermal barrier fluid to the casting surfaces as taught by the method of the present invention significantly reduces the occurrence of fires caused by the contacting of hot cast metal by excess thermal barrier fluid.

Still another advantage of the present invention over the prior art techniques is the uniformity with which the thermal barrier fluid is applied to the casting surfaces. This uniformity of application decreases the incidents of hot spots and warping and cracking of the moving casting surfaces caused by uneven heat transfer during the casting operation. It will also be appreciated that by applying a uniform thermal barrier coating to the moveable endless casting surfaces, a more uniform rate of heat transfer from the metal being cast is obtained thereby preventing the possible separation of alloying constituents within the cast metal and by providing a more evenly cooled product, the strength and overall quality of the cast metal is therefore enhanced.

Having in mind the above and other objects that will be evident from a reading of this disclosure, the present invention comprises the combinations and arrangements of parts illustrated in the presently preferred embodiment of the invention which is hereinafter set forth in sufficient detail to enable those persons of ordinary skill in the art to clearly understand the function, operation, construction and advantages of it when read in conjunction with the accompanying drawings.

DESCRIPTION OF THE PREFERRED EMBODIMENT

For purposes of illustration, the invention herein will be described as embodied in continuous casting apparatus and procedures of generally conventional types, for affecting the continuous casting of copper bar and rod. It being understood that the invention described herein is used in conjunction with a reservoir of conventional type and a conduit of conventional type for supplying thermal barrier fluid to the apparatus described herein, both of which are not shown for the sake of clarity.

Figure 1:
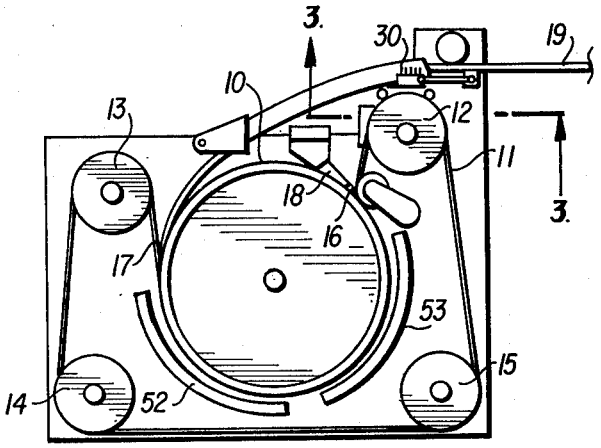
FIG. 1 is a schematic side-elevational view of an illustrative type of continuous casting apparatus arranged for the practice of one embodiment of the present invention.

Referring to FIG. 1, there is shown in schematic side-elevational view a casting machine comprising a rotatably mounted casting wheel 10 and an endless band 11 mounted for continuous movement around band support wheels 12, 13, 14 and 15 respectively. The band 11 and the casting wheel 10 are mutually disposed and arranged so that along a portion of their respective paths the band 11 contacts the casting wheel by moving through a peripheral groove inscribed upon the surface of the casting wheel so as to define between them a casting mold having a mold inlet 16 and a mold outlet 17. The facing surfaces of the casting wheel and the band constitute the casting surfaces of the apparatus.

Molten metal is supplied from a pour spout to the mold inlet 16 of the casting mold. As the metal moves through the casting mold it solidifies into a continuous bar 19 which emerges from the mold outlet 17. To promote solidification, cooling means 52 and 53 are provided to cool the metal in the casting mold.

In accordance with the embodiment of the invention depicted in FIG. 1, the casting surface of the band 11, that surface which faces the casting wheel as it traverses the casting mold, is continuously coated with a fluid, as by means schematically shown as housing 30, the fluid having appropriate thermal and mechanical properties for use as a thermal barrier in the casting process. More particularly, the fluid coating used must have appropriate thermal properties so that a uniform layer of sufficient thickness retards the initial transfer of heat from the cast metal to the casting surface without substantially increasing the time required for substantially complete solidification of the cast metal in contact with the casting surface when the fluid coating is absent. Further, the fluid coating used must have appropriate thermal properties so that the initial transfer of heat from the cast metal is limited to a rate which is less than the rate at which substantial segregation of alloy constituents would occur in the solidifying metal. It has been found that oils having a base of silicon resin, glycol, and long chain hydrocarbons are generally acceptable for this purpose.

Figure 2:
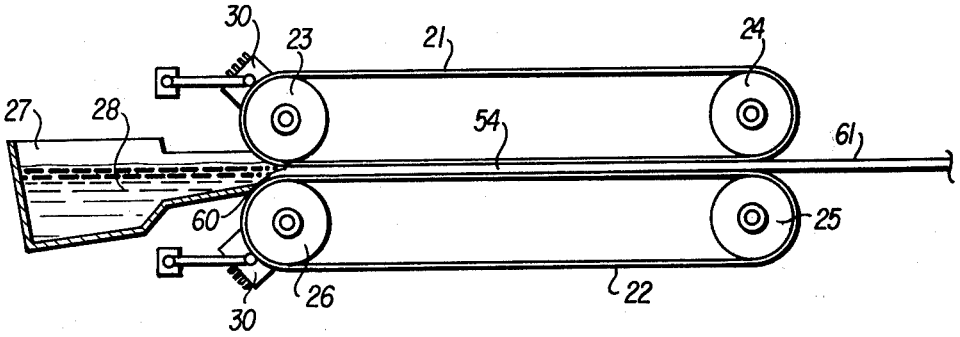
FIG. 2 is a schematic side-elevational view of a second illustrative type of a casting apparatus arranged for the practice of the present invention.

Referring to FIG. 2, there is shown in schematic side elevational view a second type of casting machine adapted for the practice of the present invention comprising, a pair of flat endless belts 21 and 22, mounted for continuous movement around guide and drive rollers 23, 24, and 25, 26, respectively. The belts 21 and 22 and their respective rollers 23, 24 and 25, 26, are mutually disposed and arranged so that in portions of their respective paths, the two belts move in parallel, closely spaced relation to each other, in the same direction and at a common velocity, so as to define between them a casting mold 54 having a mold inlet 60 and a mold outlet 61. The facing surfaces of the two belts advancing through this region constitute the casting surfaces of the apparatus.

Molten Metal 28, supplied from a trough 27, is fed continuously to the mold inlet 60, so as to be carried through the casting mold 54 by and between the synchronously moving belts 21 and 22. As the metal thus traverses the casting mold 54, it cools and solidifies into a continuous bar which emerges from the downstream end of the casting mold as indicated at mold outlet 61.

In accordance with the invention the casting surface of each of the belts 21 and 22 is continuously coated with a fluid, as by means schematically shown as housings 30, having appropriate thermal and mechanical properties for use as a thermal barrier in the casting process.

Figure 3:
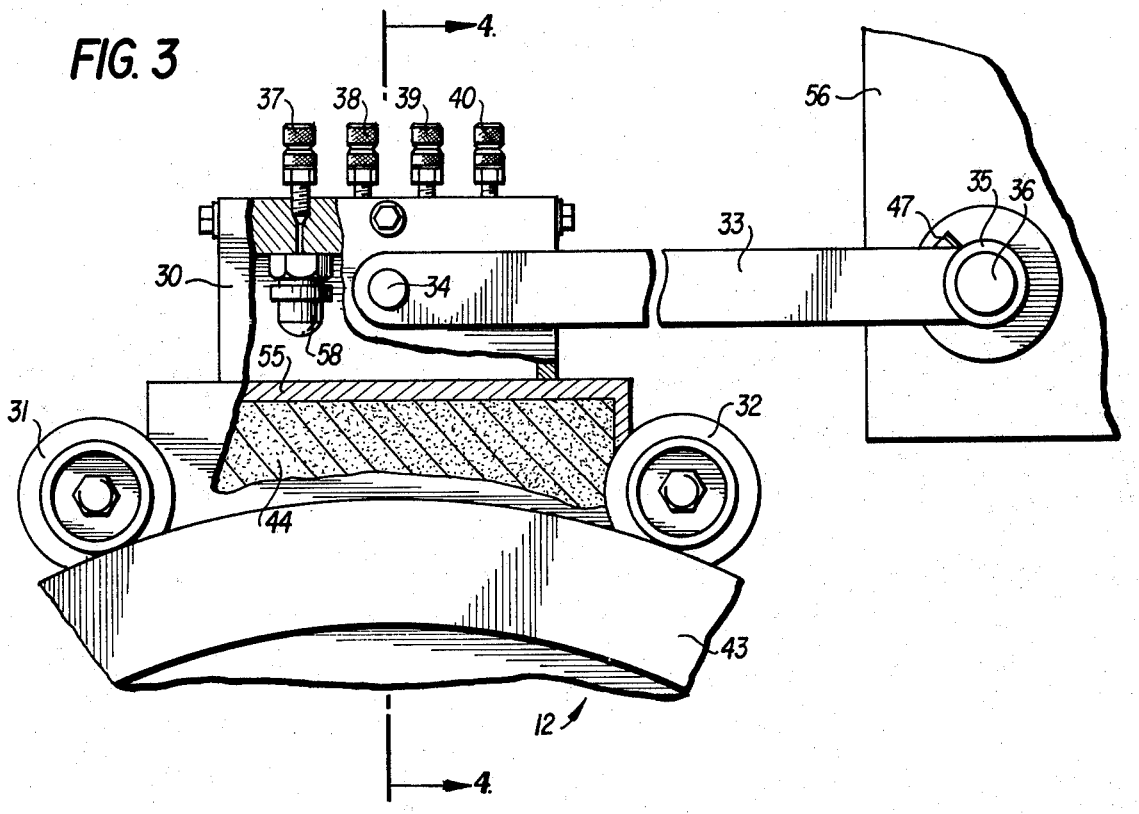
FIG. 3 is an enlarged fragmentary side-elevational view taken along line 3—3 of FIG. 1.

Referring to FIG. 3, there is shown an enlarged side elevational view of the housing 30 taken along line 3—3 of FIG. 1. In accordance with the embodiment of the present invention, housing 30 rests upon the periphery of the band support wheel 12 being held in position thereon by housing guide wheels 31 and 32 and housing mounting arm 33 which is pivotally connected to housing 30 at one end by mounting pin 34 and rigidly connected to sleeve 35 at the other end. Further sleeve 35 is rotatably mounted upon a second mounting arm 36 which is rigidly connected to the casting machine.

Needle valves 37, 38, 39 and 40 are provided so that the amounts of fluid coating directed onto the casting surface of band 11 by each of said nozzles 58 can be individually controlled. Band 11 is sealingly engaged by wiping means 44 which is positioned within housing 30 so as to describe a communicating passage 55 between the casting surface of band 11 and nozzles 58.

Figure 4:
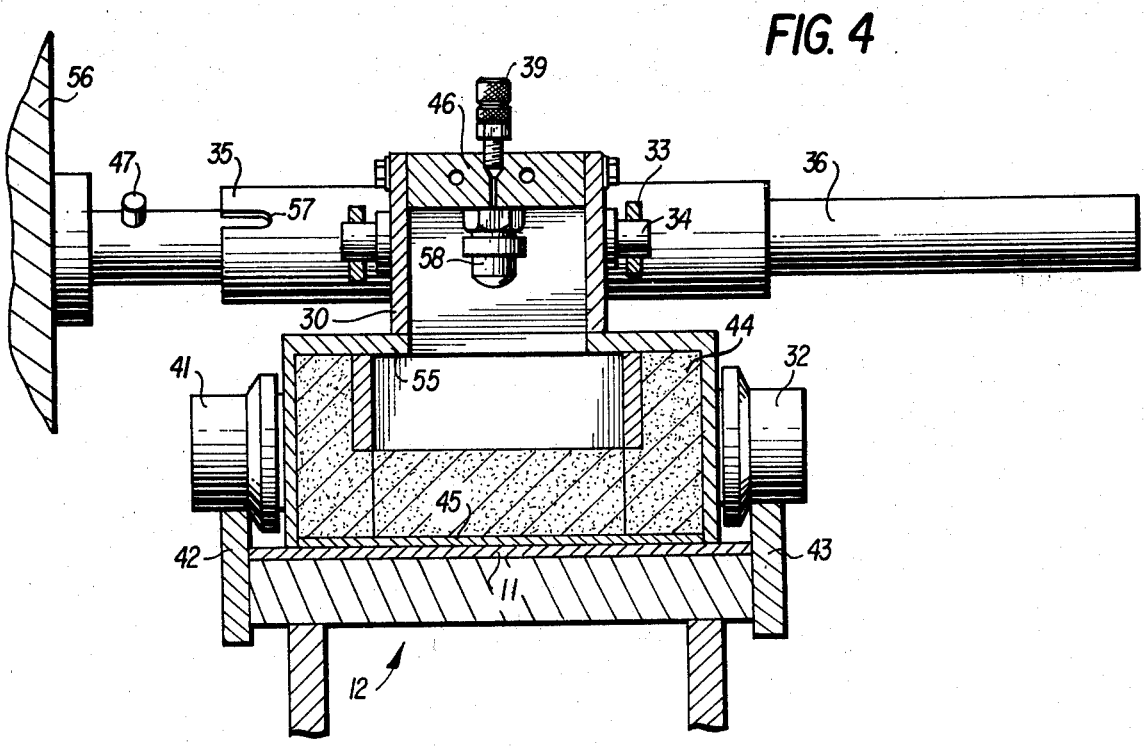
FIG. 4 is a sectional view taken along line 4—4 of FIG. 3.

Referring now to FIG. 4, which is an enlarged sectional view taken along line 4—4 of FIG. 3, arm 36 is rigidly attached to casting machine housing 56, sleeve 35 is movably mounted upon arm 36 and housing support wheels shown as 32 and 41 rests upon flanges 42 and 43 of band support wheel 12 when the apparatus is in its operating position. Band 11 is sealingly engaged by housing 30 and wiping means 44 which is so positioned within said housing to describe a communicating passage 55 between band 11 and nozzles 58 which are mounted upon means for directing jets of fluid 46. In a preferred embodiment of the present invention, wiping means 44 may be made from sponge or any porous rubber like material. As will be appreciated from the foregoing, a discrete layer of fluid coating 45 is applied to the casting surface of band 11 in the form of jets, originating from means for directing jets of fluid 46, as the band traverses the area described by communicating passage 55. To facilitate maintenance, the apparatus can be removed from its operating position by rotating sleeve 35 upon arm 36 and positioning projection 47 within slot 57 whereby the apparatus is locked into its non-operative position and does not engage wheel 12 and band 11.

Figure 5:
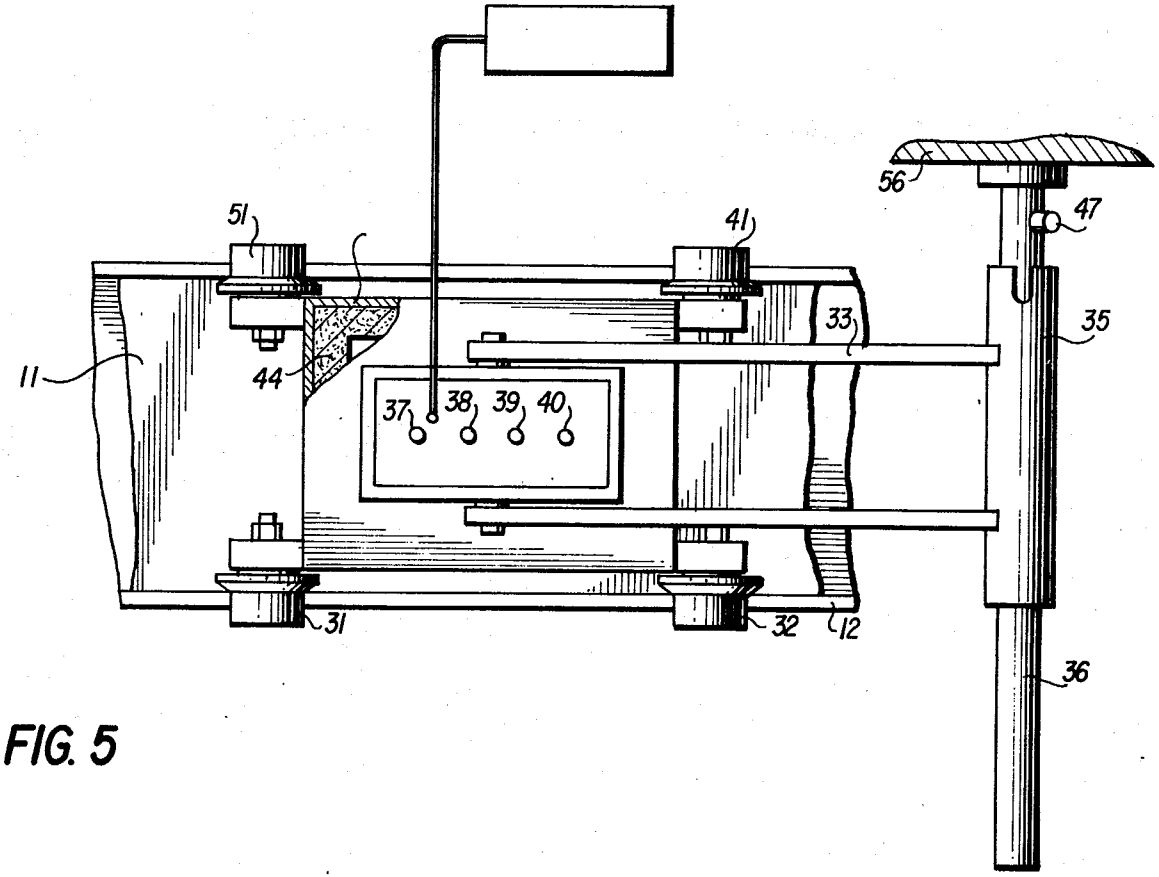
FIG. 5 is a top view of FIG. 3 of the present invention.

FIG. 5 is a top view of FIG. 3 depicting housing 30 mounted upon wheel 12. Shown in partial section is communicating passage 55 within wiping means 44.

As will be appreciated from the foregoing description the coating applied by the practice of this invention serves to protect the casting surface of the endless band against damage such as might otherwise result from direct contact with the bar being cast. Thus the coating applied by the method taught by this invention markedly increases the lifetime of said band when compared to the lifetime of a band not having a coating applied by this method.

For a further and more specific illustration of the present invention it will now be described in terms of actual operation in a method for continuously casting copper bar using a wheel and belt continuous casting machine of conventional design.

To provide the required amount of coating to cast a 4.4 square inch bar of copper at a rate of 20 tons per hour in an apparatus of the type described in FIG. 1 and to insure uniform heat transfer from the solidifying metal through the band thereby preventing distortion of the band, a fluid coating approximately 0.0013 inches thick is required. To obtain the required coating thickness using the method and apparatus of the present invention, UCON LB300X, a glycol base oil having a refractive index of 1.452 $N^{20}_D$, a density of 0.979 at 100°F, a Saybolt viscosity of 300 sec at 100°F and an Open Cup Flash Point of 490°F, manufactured and sold under this trademark by Union Carbide, is supplied to means for directing jets at a rate of 0.50GPH by conventional means with an atomizing air pressure of 10 psi. As the band passes under the housing and through the communicating passage at a speed of 39.3 fpm, jets of UCON LB300X are sprayed upon its casting surface resulting in a coating approximately 0.0013 inches thick. Excess fluid coating is absorbed by the wiping means as it traverses the casting surface of the band thereby preventing the formation of a fluid coating fog in the air around the apparatus. Further the wiping and absorbing action of the wiping means evenly distributes the fluid coating upon the casting surface of the band and prevents drips, splashes and spills of oil into the casting machine coolant supply.

The invention has been described in conjunction with one particular embodiment and it is to be understood that obvious modifications and changes may be made without departing from the spirit and scope of the invention as defined in the appended claims and the invention is intended to cover all such modifications and changes which fall within the scope of the claimed invention.

What is claimed is:

1. In an apparatus for the continuous casting of metal including a movable endless band wherein one surface of said band comprises a casting surface; means adjacent said surface for continuously delivering molten metal thereto and means for continuously removing cast bar therefrom, the improvement comprising;

a. a housing sealingly engaging a portion of said moving casting surface;

b. wiping means within said housing and in frictional contact with said moving casting surface for uniformly dispersing a fluid upon said moving casting surface, and c. means within said housing for directing jets of a fluid coating onto the engaged portion of said moving casting surface, said jets being directed along paths substantially perpendicular to the direction of movement of said moving casting surface.

2. The apparatus for claim 1 further including means for mounting said housing upon said continuous casting apparatus.

3. The apparatus of claim 1 wherein said means for directing jets of fluid coating comprises a plurality of nozzles and means for individually adjusting the amount of fluid coating directed onto said surface by said nozzles.

4. The apparatus of claim 1 wherein said wiping means comprises a porous and absorbent material having described therein a communicating passage for transmission of said jets of fluid coating therethrough and onto said casting surface.

5. In an apparatus for the continuous casting of metal including a moveable endless casting surface; means adjacent said surface for continuously delivering molten metal thereto; means for continuously removing cast bar therefrom and means for applying a fluid coating to said moveable endless casting surface, said means for applying fluid comprising a housing sealingly engaging a portion of said moving casting surface, wiping means within said housing and in frictional contact with said moving casting surface and means within said housing for directing jets of a fluid coating onto the engaged portion of said moving casting surface, the improvement comprising:

a. a pair of arms rigidly attached at one end to a sleeve and pivotally attached at the other end to said housing, b. a third arm rigidly attached at one end to said continuous casting apparatus upon which said sleeve is movably mounted, and c. means connected to said housing for positioning said housing relative to a casting surface support wheel, whereby said wiping means constantly engages the casting surface as it moves across said support wheel.

6. The apparatus of claim 5 wherein at least one of said casting surfaces comprises a moving endless band.

7. In an apparatus for applying a fluid coating to a band, wherein one surface of said band comprises a casting surface, which engages the circumferences of a plurality of band support wheels, the band, together with other mold means, comprising a machine for the continuous casting of metal, the improvement comprising:

a. a housing sealingly engaging a portion of said casting surface;

b. wiping means within said housing and in frictional contact with said casting surface;

c. means within said housing for directing jets of thermal barrier fluid onto the engaged portion of said casting surface, said jets being directed along paths substantially perpendicular to said casting surface; and d. means for mounting said housing upon said continuous casting machine.

* * * * *